US005660436A

United States Patent [19]

Wilson

[11] Patent Number: 5,660,436

[45] Date of Patent: Aug. 26, 1997

[54] LATERALLY EXTENDABLE FURNITURE

[76] Inventor: Michael Wilson, 716 Crescent Blvd., Glen Ellyn, Ill. 60137

[21] Appl. No.: 560,443

[22] Filed: Nov. 17, 1995

[51] Int. Cl.[6] ..... A47C 13/00

[52] U.S. Cl. ..... 297/233; 297/236

[58] Field of Search ..... 297/232, 233, 297/235, 236, 452.4, 452.63; 108/5, 54.1; 40/320, 491

[56] References Cited

U.S. PATENT DOCUMENTS

| | | | |
|---|---|---|---|
| 371,091 | 10/1887 | Miller | 297/236 X |
| 956,837 | 5/1910 | Tedemann et al. | 297/233 X |
| 2,688,997 | 9/1954 | Miller | 297/233 X |
| 2,696,246 | 12/1954 | Putnam | 297/232 X |
| 2,711,786 | 6/1955 | Weiss | 297/232 X |
| 3,743,351 | 7/1973 | Harris | 297/233 X |
| 5,235,768 | 8/1993 | Eder | 40/488 |

*Primary Examiner*—Peter R. Brown
*Attorney, Agent, or Firm*—Wood, Phillips, VanSanten, Clark & Mortimer

[57] ABSTRACT

A laterally extendable furniture device includes a primary support section and a supplemental support section slidably connected to the primary support section for movement between a retracted position and an expanded position. At the retracted position the supplemental support section is stored within the primary support section, and at the expanded position the supplemental support section extends laterally from the primary support section to provide an expanded support surface. The laterally extendable furniture design can readily be adapted to a variety of furniture pieces including chairs, tables, desks and shelves. The furniture device is manufactured from molded plastic components, making it easy and economical to manufacture and durable.

24 Claims, 4 Drawing Sheets

LATERALLY EXTENDABLE FURNITURE

FIELD OF THE INVENTION

The present invention relates generally to furniture, and, more particularly, to furniture which expands laterally to provide an expanded support surface.

BACKGROUND OF THE INVENTION

In many types of furniture, such as shelves, chairs, tables, bookstands, etc., it is desirable to have a support surface which can be expanded to provide additional support space or retracted when not in use. For example, numerous chair designs have been proposed in the past which provide for an expandable seating area. Examples of such chairs can be found in U.S. Pat. Nos. 3,743,351; 2,242,617 and 1,530,420. Such chairs are beneficial because they can be expanded to provide additional seating space or retracted to minimize required storage space. However, past designs for expandable chairs, such as those of the above-identified patents, have been cumbersome to use. A such, these designs are unsuitable for many applications and they are particularly unsuitable for use by small children. These designs are also complex and costly to manufacture. As a result, these designs are particularly unsuitable for outdoor furniture, i.e., lawn chairs, where consumers place an emphasis on low cost, durable products. Moreover, know designs cannot readily be adapted for use in connection with other types of furniture, such as tables, desks or shelves.

SUMMARY OF THE INVENTION

Accordingly, an object of the present invention is to provide a furniture device having a support surface which can be readily expanded to provide an expanded support surface or retracted to reduce the space required for storage.

Another object of the present invention is to provide a laterally extendable furniture device which is simple to operate.

Yet another object of the present invention is to provide a laterally extendable furniture device which is simple and economical to manufacture.

Still another object of the present invention to provide a design for extendable furniture which is readily adaptable to different furniture pieces.

A further object of the present invention is to provide a chair having a seating surface which can be extended to provide additional seating space or retracted to reduce the space required for storage.

Another object of the present invention is to provide a laterally expandable furniture device which is suitable for use by young children, e.g., between the ages of 3 and 10 years old.

Yet another object of the present invention is to provide a device for encouraging social skills and sharing by relatively young children.

Still another object of the present invention is to provide a laterally expandable furniture device having a surface adapted to carry a printed message such that the message changes when the device is moved between its expanded and retracted positions.

The above and other objects and advantages are provided by a laterally extendable furniture device comprising a primary support surface comprising first and second laterally spaced side support frames and a first support member which is hollow and extends laterally between the first and second side support frames. A supplemental support section is slidably connected to the primary support section. The supplemental support section comprises a third side support frame positioned on the side of the second side support frame opposite that of the first side support frame and a second lateral support member having one end rigidly connected to the third side support frame and the other end slidably engaging within the first support member to permit the supplemental support section to slidably move between an extended and a retracted position. At the retracted position the third side support frame is positioned proximally to the second side support frame and the second support member is slid into the first support member. At the extended position the third side support frame is distally spaced from the second side support frame and the second support member is extended from the first support member to provide an expanded support surface.

According to one embodiment the laterally extendable furniture device comprises a table. According to another embodiment the laterally extendable furniture device comprises a chair, wherein the first and second support surfaces are positioned to support a person in a seated position.

Other objects and advantages of the invention will become apparent upon reading the following detailed description and appended claims, and upon reference to the accompanying drawings.

DETAILED DESCRIPTION OF THE PREFERRED EMBODIMENTS

Referring now to drawings several embodiments of laterally extendable furniture devices in accordance with the present invention are described. Specifically, FIGS. 1–5 illustrate a first embodiment of a laterally extendable chair 10, FIGS. 6–7 illustrate a second embodiment of a laterally extendable chair 10, and FIG. 8 illustrates a laterally extendable table 11. The same references numerals have been used to identify like components in the three illustrated embodiments. Although embodiments for chairs and a table have been illustrated, it is to be understood that the principles of the present invention extend to other furniture devices, such as desks and shelves for example.

Figure 1:
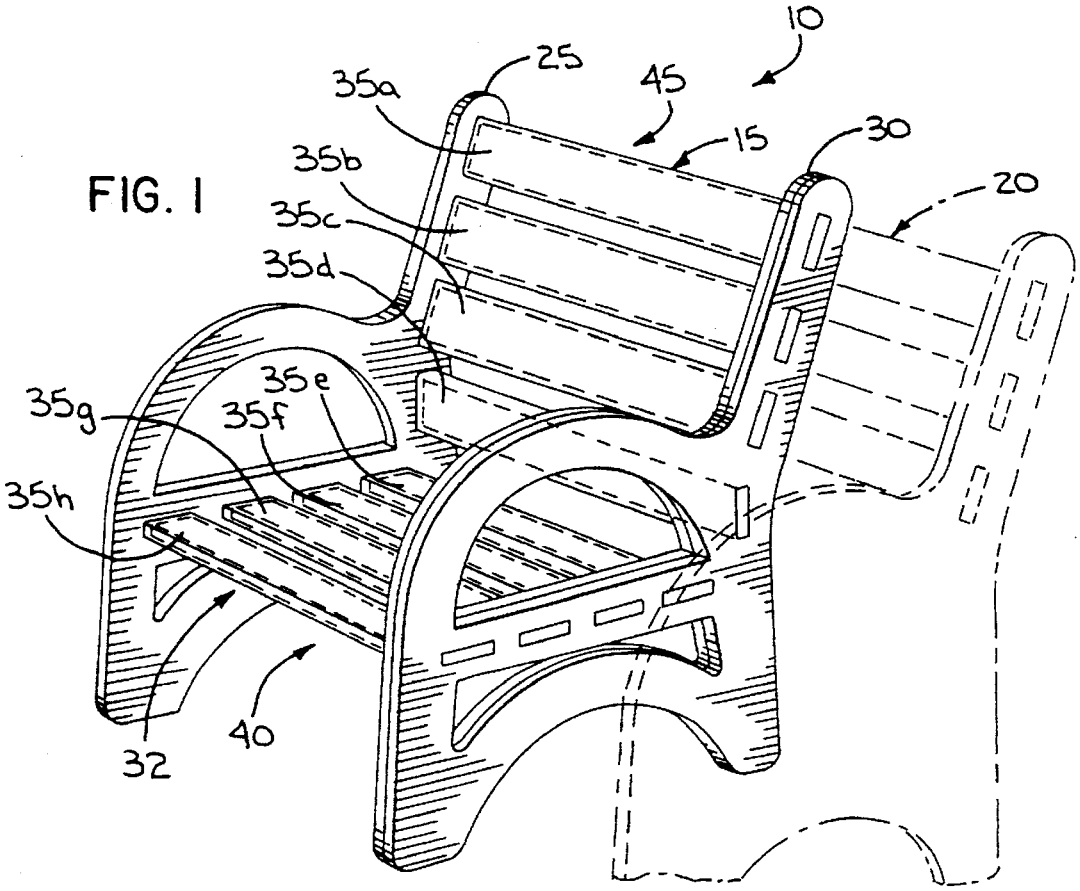
FIG. 1 is a perspective view of a laterally extendable chair in accordance with the present invention, wherein the chair is shown in its extended portion in broken lines.

Referring now to FIGS. 1–5, a laterally extendable chair 10 includes a primary support (or seating) section 15 and a supplemental support (or seating) section 20 (shown in broken lines in FIG. 1). The supplemental seating section.20 is slidably connected to the primary seating 15 section for movement between a retracted position (See FIG. 3) at which the supplemental seating section is stored within the primary seating section, and an expanded position (See FIG. 2) at which the supplemental seating section extends laterally from the primary seating section to provide additional seating space.

The primary seating section 15 comprises first and second laterally spaced side support frames 25, 30. A first support member 32 extends laterally between the first and second side support frames 25, 30. As illustrated, the first support comprises a first set of slats 35*a–h*. The slats are arranged to support a person in a seated position. More specifically, the slats 35 in the first set are arranged to form a bottom support 40 and a back support 45 which extends upwardly from the back edge the bottom support. In the chair illustrated in FIGS. 1–5, the bottom support 40 is comprised of four slats 35*e–35h* and the back support 45 is also comprised of four slats 35*a–35d*.

Figure 4:
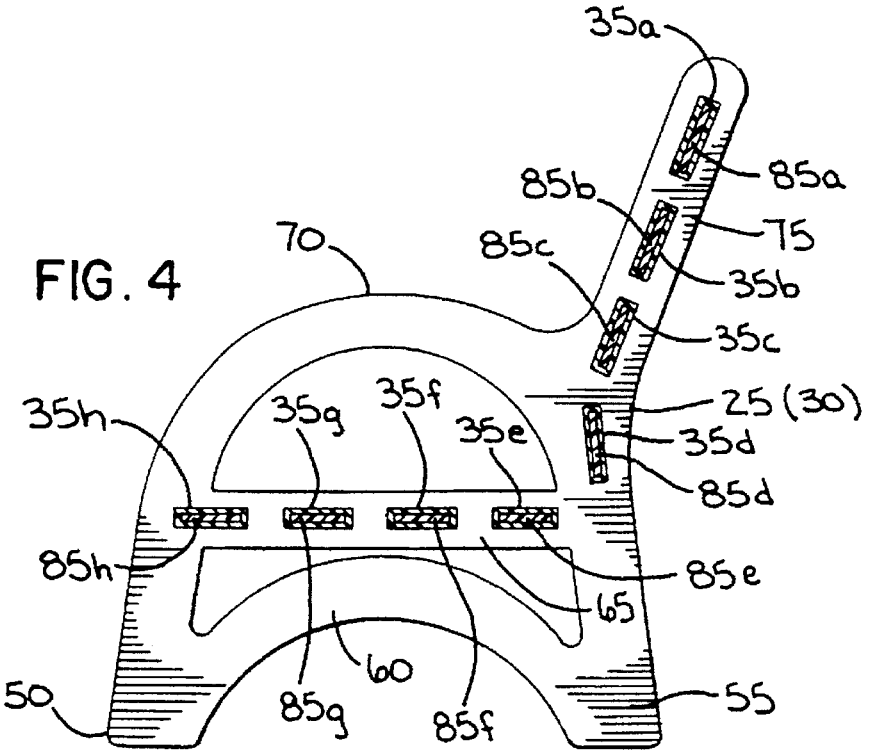
FIG. 4 is a sectional side view of the chair along line 4—4 of FIG. 3.

As can best be seen in FIG. 4, each of the side support frames 25, 30 includes a pair of ground engaging legs 50, 55. The legs extend upwardly and are joined by a plurality of integrally formed cross members which extend between the legs. Specifically, each side support frame includes a lower cross member 60, a middle cross member 65, and an upper cross member 70. The upper cross member 70 is curved upwardly above the plane of the bottom support 40 to form an arm rest. The middle cross member 65 extends generally horizontally and is adapted for connection to the slats 35. For this purpose, the middle cross member illustrated in FIGS. 1–5 includes a plurality of apertures, each of which is sized to form a frictional fit about the exterior of one of the slats 35*e–35h* forming the bottom cross member 40. As will be apparent, other methods may be used to connect the support frames to the slats 35 without departing from the scope of the claimed invention. For example, the slats may be secured to the frames by adhesives or sonic welding. Alternatively, fasteners, such as screws or rivets, may be used for this purpose (See, e.g. FIGS. 5–8). Similarly, a vertical member 75 extends upwardly from the back edge of the side support frame. The vertical member 75 includes a plurality of apertures, each of which forms a frictional fit about the exterior of one of the slats 35*a–35d* forming the back support 45.

Although the slats 35 have been illustrated as having a generally rectangular cross section (see, e.g. FIG. 4), it will be appreciated that the slats may readily assume other cross-sectional shapes such as circular or oval. In addition, while the bottom support 40 and back support 45 are illustrated as being formed from multiple slats each of these supports could readily be formed from a single slat (see, e.g. FIG. 8) or, alternatively, the bottom support and back support could be integrally formed with each other and/or with the side support frames 25, 30. Additionally, it will be appreciated that the side support frames 25, 30, 80 can take other configurations without departing from the claimed invention.

Figure 2:
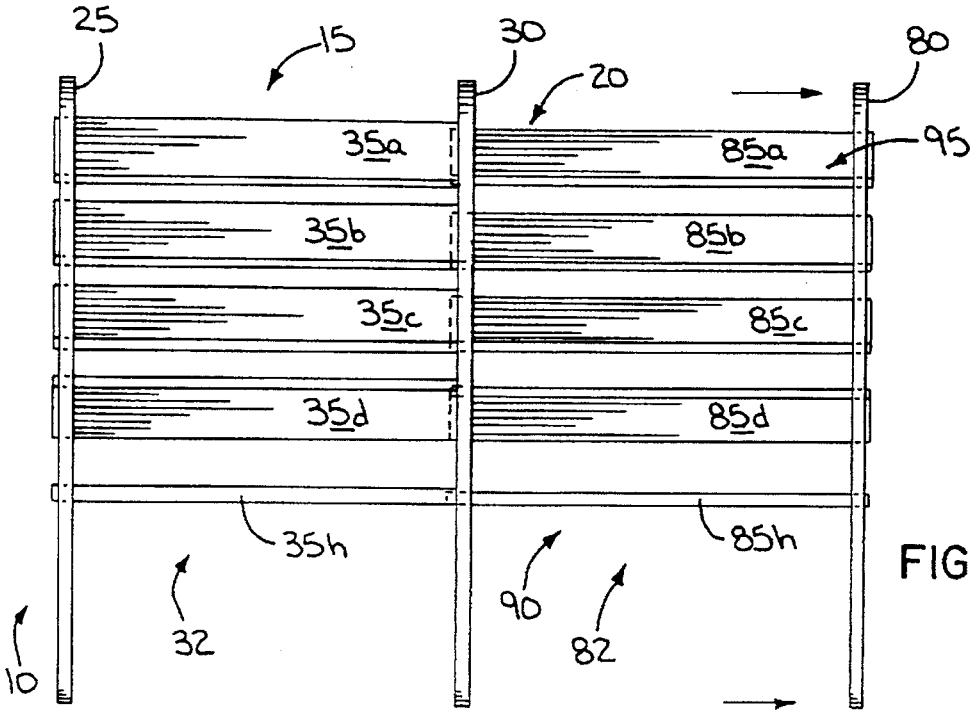
FIG. 2 is a front elevation view of the chair of FIG. 1 in its fully extended position.
Figure 3:
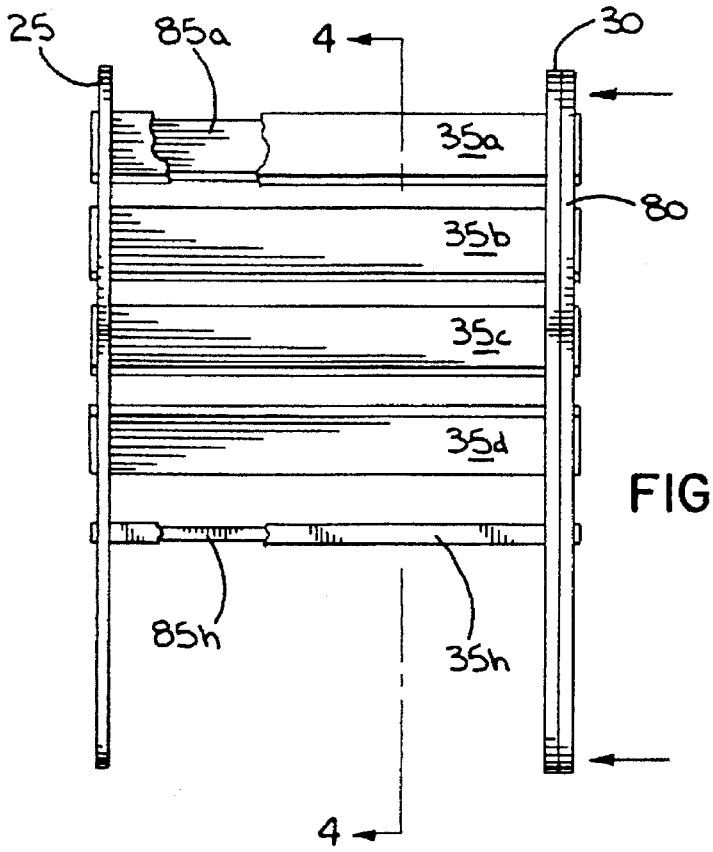
FIG. 3 front elevation view of the chair of FIG. 1 in its fully retracted position.

Referring now to FIG. 2, the supplemental support or seating section 20 comprises a third side support frame 80 having generally the same construction as the first and second support frames 25, 30. The supplemental seating section 20 further includes a second support lateral member 82 which has one end rigidly connected to the third support frame 80 and the other end slidably connected with respect to the second or middle support frame 30. As illustrated, the second lateral support 82 comprises a second set of slats 85*a–h*, equal in number to that of the first set of slats 35*a–h*. The slats 85*a–h* in the second set are arranged so that the supplemental seating section includes a respective bottom support 90 and a back support 95 extending upwardly from the back edge of the bottom support. Specifically, the bottom support 90 is comprised of four slats 85*e–85h*, and the back support 95 is comprised of four slats 85*a–85d*.

Each slat 85*a–85h* in the second set has one end fixedly connected to the third support 80 and the other end slidably connected with respect to the second support 30, and, hence, the primary seating section 15. For this purpose, the slats 35*a–35h* in the first set are hollow and the slats 85*a–85h* in the second set are sized and positioned to slide into associated slats in the first set. Specifically, each slat 85*a–85h* in the second set slidably engages into the end of a different one of the slats 35*a–35h* in the first set to permit the third support 80 to slidably move between the retracted position (see FIG. 3) and the expanded position (see FIG. 2). When the supplemental seating section 20 is at the retracted position (FIG. 3), the third support 80 is positioned proximally to the second support 30 and the slats 85*a–85h* in the second set are slid essentially completely into the slats in the first set. When the supplemental seating section 20 is moved to its extended position (FIG. 2), the third support 80 is distally spaced from the second support 30 and the slats 85 in the second set are extended from the first set of slats 35 to provide additional seating space.

Figure 5:
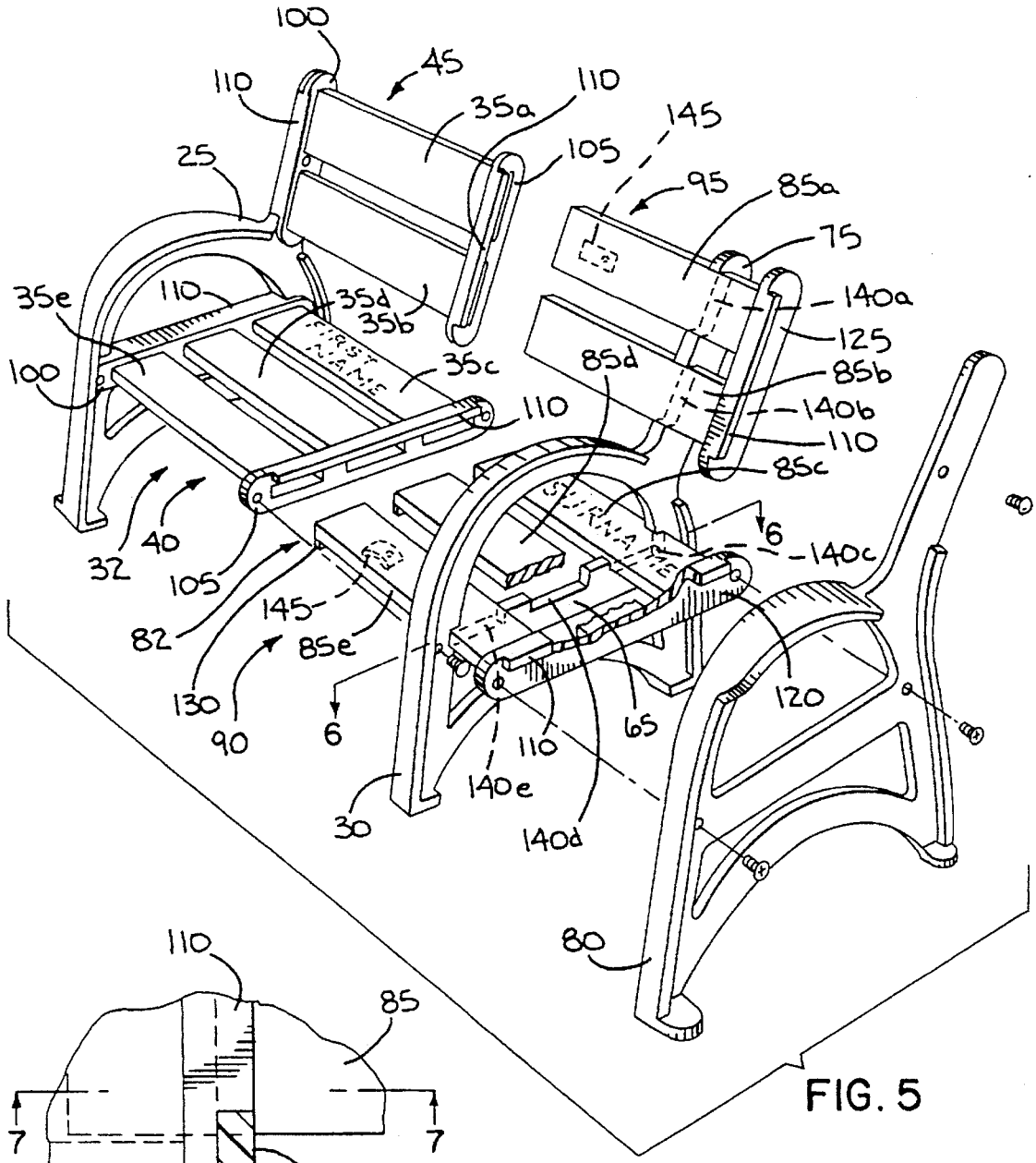
FIG. 5 is an exploded perspective view of a second embodiment of a laterally extendable chair in accordance with the present invention.
Figure 6:
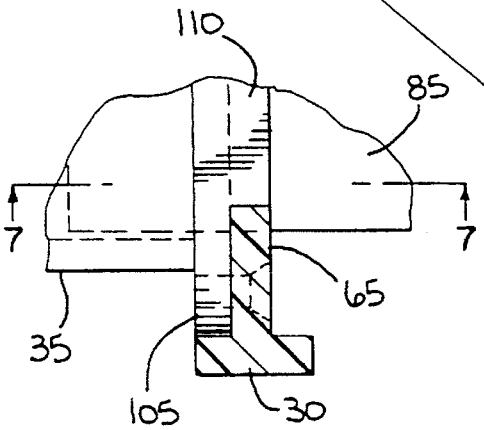
FIG. 6 is a partial fragmented top elevation view of the chair along line 6—6 of FIG. 5 (with the chair in its fully assembled state).
Figure 7:
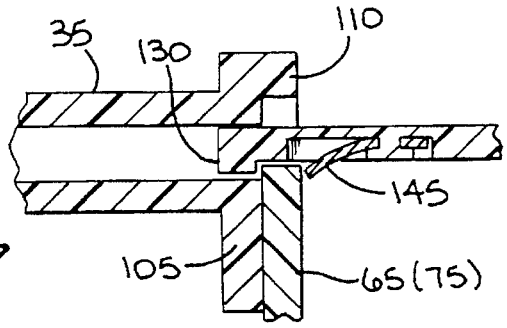
FIG. 7 a sectional view along line 7—7 FIG. 6.
Figure 8:
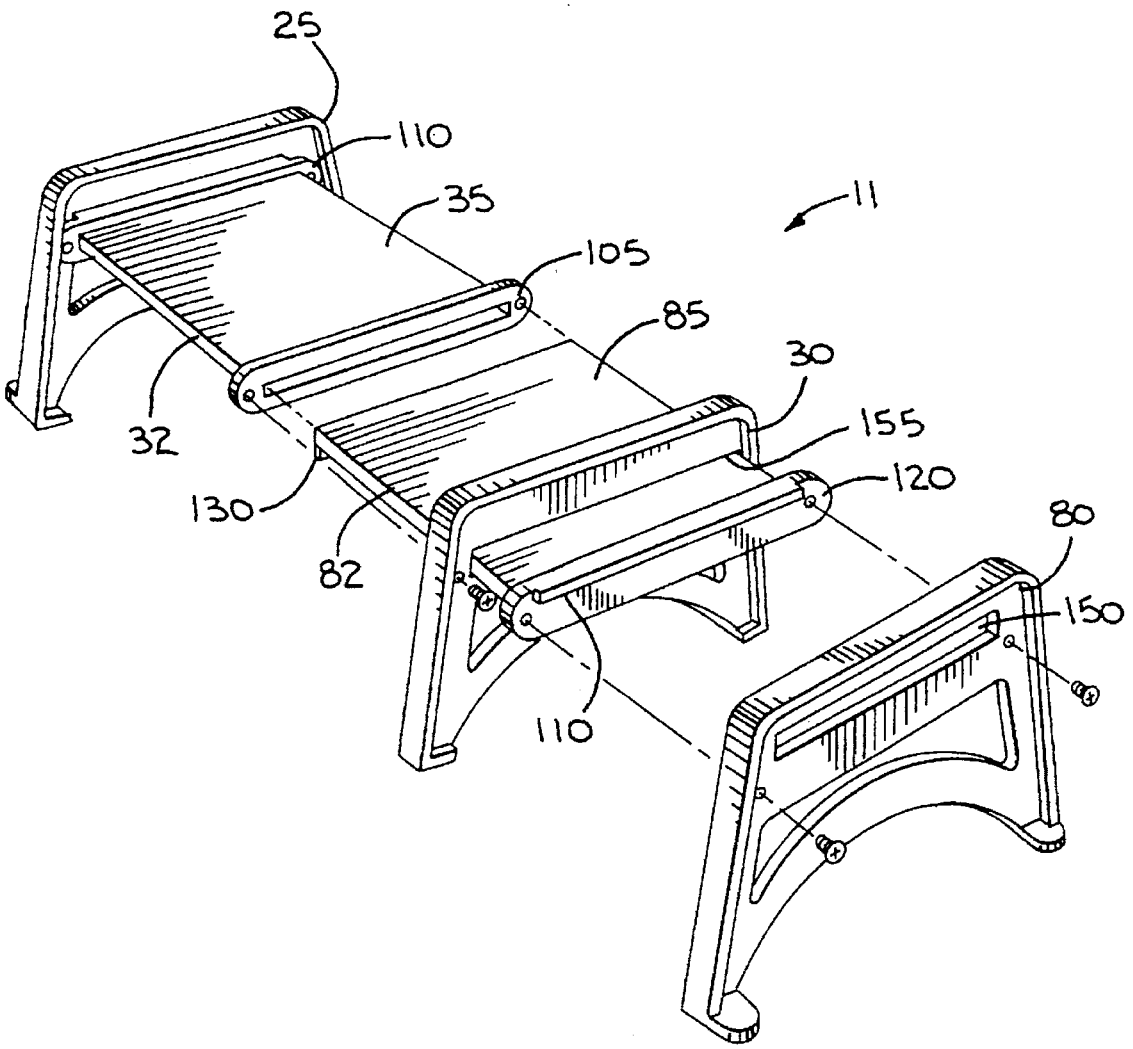
FIG. 8 is an exploded perspective view of is a laterally extendable table in accordance with the present invention.

Referring now to FIGS. 5–7, a second embodiment of a laterally expandable chair is illustrated in which the bottom supports 40, back supports 45 and the side support frames 25, 30, 80 are separately molded from each other. The bottom and back supports 40, 45 are in turn fixedly secured to the side support frames 25, 30, 80 by fasteners such as screws or rivets. Separately molding the components as illustrated in FIGS. 5–7 is beneficial in that it allows the furniture to be shipped in a disassembled state, thereby reducing the space required for shipping and warehousing. The chair is designed to have a minimal number of components, thereby simplifying the assembly process for the end user. Separately molding the components in the manner illustrated is also beneficial because it simplifies the manufacturing process, thereby reducing the cost of production. It will be appreciated however, that the components of the respective seating sections 15, 20 can also be integrally molded with each other. For example, the first set of slats 35 could be integrally molded with the first and second support frames 25, 30, whereas the second set of slats 85 could be integrally molded with the third support frame 80.

The components are preferably molded from a polymeric material such as polyethylene or polypropolene. As such, the chair is relatively inexpensive and easy to manufacture. Such materials are also beneficial because they are relatively durable in comparison to materials such as fabric, wood and metal, and are particularly well suited for making outdoor furniture. As was mentioned above, the second embodiment shown in FIGS. 5–7 is designed to be shipped in a disassembled state and assembled by the end users. For this purpose, the slats 35*a–e* forming the bottom and back supports 40, 45 of the primary seating section extend between respective first and second end connectors 100, 105. The first and second end connectors 100, 105 of the bottom support are designed to engage with the middle cross members 65 of the first and second side support frames 25, 30, respectively. For this purpose, each of the end connector 100, 105 includes an upper lip 110 (see FIG. 7) which is designed to engage along the top edge of a respective middle cross member 65. The lips 110 rest on the middle cross members 65 to distribute forces imparted on the slats when a person sits in the chair. It will be appreciated that lips could also be formed along the bottom edges of the middle cross members 65 of the side support frames 25, 30, 80 for this purpose. Similarly, the end connectors 100, 105 of the back support 45 are designed to engage into the vertical supports 75 of the first and second side support frames 25, 30.

The slats 85*a–e* forming the bottom and back supports 90, 95 of the supplemental seating section are joined along their outer ends by end connectors 120, 125. Conversely, the inner ends of these slats 85*a–e* include downwardly extending legs 130 (see FIG. 7) having a height which is slightly less than the height of the openings in the first slats 35*a–e*.

During the assembly process, the first end connectors 100 are initially connected to the first side support frame 25 via fastener such as plastic screws or rivets. The inner ends of the slats 85*a–e* from the supplemental seating section are then extended through the second side support frame 30 and into the hollow ends of the slats 35*a–e* in the first set. A plurality of slots or recesses 140*a–e* are formed in the middle cross member 65 and the vertical support 75 of the second side support frame 30. Each of these recesses 140 is positioned to align with and slidably engage a different one of the slats 85*a–e* in the second set. Once the ends of the slats 85*a–e* in the second set are slid into the slats 35*a–e* in the first set, the second side support frame 30 is secured to the second end connectors 105 via fasteners. The end connectors 120, 125 of the slats of the second set slats are then secured to the third side support 80 via fasteners.

As can best be seen by referring to FIG. 7, the extendable chair 10 may include a means for preventing the first and second seating sections 15, 20 from being inadvertently disconnected from each other during sliding movement. Specifically, the recesses 140 in the second side support 30 have a depth which is slightly greater than the thickness of the slats 85 in the second set, but which is less than the height of the legs 130 formed on the ends of these slats. As a result, the middle cross member 65 and the vertical member 75 of the second side frame 30 function as stops which engage against the legs 130 to prevent the first and second seating sections 15, 20 from being disconnected from each other during relative sliding movement.

Also illustrated in FIG. 7 is a means for releasably locking the supplemental seating section at its extended position. Preferably the locking means comprises locking tabs 145 formed near the inner ends of two of the slats 85*a*, 85*e* in the second set of slats. The tabs 145 are normally biased outwardly (by means such as a coil spring for example) to a position at which their edges extend beyond the face of a respective slat. The tabs 145 are manually compressible to a position at which their outer faces are substantially flush with the face of a respective slat. As the supplemental seating section 20 is moved towards its extended position, the ends of the locking tabs 145 move beyond the edge of the second side support frame 30. When this occurs, the tabs 145 snap outwardly and into locking engagement with edge of the second side support frame 30. In order to return the supplemental seating section 20 to its retracted position, it is necessary to push the tabs 145 inwardly Until their edges are substantially flush with the face of a respective slat.

Referring now to FIG. 8, an expandable table 11 is illustrated. The table 11 shown in FIG. 8 uses similar components to those used in the chair illustrated in FIGS. 5–7; hence, only the primary differences will be described. As can be seen, the table 11 does not include any back support, as was provided in the previously described chairs. Additionally, the first and second lateral supports 32, 82 are each comprised of a single, enlarged slat or member 35, 85, as opposed to a plurality of slats. As will be appreciated, using a single slat is more suitable for a table than using a plurality of slats.

The first and third side support frames 25, 80 each include a single opening 150 for engaging with the support lip 110 formed on the respective end connectors 105, 120. Conversely, the middle or second support 30 has an opening 155 which slidingly engages about the second lateral support member 82. The opening 155 has a height which is slightly greater than the thickness of the support 82, but which is less than the height of the downwardly extending leg formed on the end of the support 82. Thus, when the center support frame 30 is affixed to the end connector 105, the support frame 30 serves as a stop which abuts against the leg 130 to prevent the support 85 from becoming inadvertently disengaged from the first support 32 during relative sliding movement. Since the opening 155 is smaller than the height of the leg 130, it is necessary to tilt the support 82 pass the leg 130 through the opening during assembly.

Moreover, as can be seen, the second end connector 105 does not include a protruding support lip 110. Rather, a support lip (not shown) is formed in the second side support frame 30 below the opening 155. The support lip from the second side frame 30 engages against the bottom edge of the end connector 105 to support the end connector 105, and hence the member 32, against downward forces.

Another difference from the prior embodiments is that the side support frames 25, 30, 80 do not include armrests. As will be appreciated, the legs of the support frames 25, 30, 80 can be lengthened or shortened during manufacture, depending on the intended purpose of the table. Moreover, as will be appreciated, the design illustrated in FIG. 8 can readily be modified to form shelving having multiple levels of lateral support members.

The extendable furniture devices disclosed herein are especially suitable for use as children's furniture. Specifically, this furniture, and particularly the chairs, can be used during a child's developmental years to encourage social skills and sharing. To further encourage this behavior the slats can be labeled with written messages or images which change when the chair is moved between its expanded and retracted positions. Specifically, part of the message can be printed on the first slats 35 and the remainder of the message can be printed on the second slats 85, such that the complete message can be read when the chair is moved to its extended position. For example, a child's first name can be printed on one of the first slats 35, whereas the child's surname could be printed on one of the second slats 85.

The extendable furniture disclosed herein is also well-suited for use by small children because it is relatively easy to use when compared to prior extendable chairs. It will be appreciated, however, that this furniture is particularly suitable for any application requiring a low cost, durable and easily operated extendable chair.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A laterally extendable furniture device comprising:

a primary support section comprising:

first and second laterally spaced side support frames; and a first support member which is hollow and extends laterally between the first and second side support frames; and a supplemental support section slidably connected to the primary support section, the supplemental support section comprising:

a third side support frame positioned on the side of the second side support frame opposite that of the first side support frame; and a second support member having one end rigidly connected to the third side support frame and the other end slidably engaging within the first support member to permit the supplemental support section to slidably move between a retracted position in which the third side support fame is positioned proximally to the second side support frame and in which the second support member is slid into the first support member, and an extended position in which the third side support frame is distally spaced from the second side support frame and in which the second support member is extended from the first support member to provide an enlarged support surface, said second support member having a length extending in a lateral direction and a cross-sectional configuration taken transversely to the length of the second support member that is non-circular, said hollow in the first support member having a shape that is complementary to the cross-sectional configuration of the second support member so that a) the second support member is guided by and within the first support member between the retracted and extended positions and b) the first and second support members are keyed to each other to limit relative rotational movement between the first and second support members around the length of the second support member.

2. A laterally extendable furniture device as set forth in claim 1, wherein the first support member defines a first support surface, the second support member defines a second support surface, and the first and second support surfaces are generally horizontal.

3. A laterally extendable furniture device as set forth in claim 1, wherein the first and second support members each comprise a plurality of slats each with user support surfaces that are directly exposed to be engaged from above by a user of the device.

4. A laterally extendable furniture device as set forth in claim 3, wherein the slats each have a generally rectangular cross-sectional configuration.

5. A laterally extendable furniture device as set forth in claim 1, wherein the device comprises a chair, the first support member defines a first support surface, the second support member defines a second support surface, and the first and second support surfaces are generally horizontal.

6. A laterally extendable furniture device as set forth in claim 1, wherein the device comprises a table.

7. A laterally extendable furniture device as set forth in claim 1, further comprising means cooperating between the first and supplemental support sections for preventing the first and supplemental support sections from being fully separated from each other as an incident of the supplemental support section being slid relative to the first support section.

8. A laterally extendable furniture device as set forth in claim 1, further comprising means cooperating between the first and supplemental support sections for releasably locking the supplemental support section in the extended position.

9. A laterally extendable chair comprising:

a primary seating section; and a supplemental seating section slidably connected to the primary seating section for movement in a lateral direction relative to the primary seating section between a retracted position in which the supplemental seating section is stored within the primary seating section and an extended position in which the supplemental seating section extends laterally from the primary seating section to provide additional seating space, said primary seating section comprising a first plurality of slats having a length in the lateral direction and the supplemental seating section comprising a second plurality of slats having a length in the lateral direction, said slats in the primary and supplemental seating sections being engageable, one within the other, and guiding the supplemental seating section in movement laterally relative to the primary seating section between the extended and retracted positions, the first plurality of slats cooperatively defining a support surface having a substantial area to be directly engaged by, and support, a user in a seated position on the chair.

10. A laterally extendable chair as set forth in claim 9, wherein the seating sections are formed from a molded material.

11. A laterally extendable chair as set forth in claim 10, wherein the chair molded from a polymeric material.

12. A laterally extendable chair as set forth in claim 9, wherein the primary seating section comprises:

first side support frame; and second side support frame laterally spaced from the first side support frame, the first plurality of slats extending between the first and second side support frames.

13. A laterally extendable chair as set forth in claim 12, wherein the supplemental seating section comprises a third side support frame and the slats in the second plurality of slats each having one end rigidly connected to the third side support frame and the other end slidably connected to the second side support frame.

14. A laterally extendable chair as set forth in claim 13, wherein the slats in the first plurality of slats are each hollow and wherein the slats in the second plurality of slats are sized and positioned to slide into the slats in the first plurality of slats.

15. A laterally extendable chair as set forth in claim 9, wherein each seating section includes a respective bottom support and a back support extending upwardly from the back of a respective bottom support.

16. A laterally extendable furniture device as set forth in claim 9, further comprising means cooperating between the first and supplemental support sections for preventing the first and supplemental support sections from being fully separated from each other as an incident of the supplemental support section being slid relative to the first support section.

17. A laterally extendable furniture device as set forth in claim 9, further comprising means cooperating between the first and supplemental support sections for releasably locking the supplemental support section in the extended position.

18. A laterally extendable chair comprising:

a primary seating section comprising:

first and second laterally spaced side support frames; and a first plurality of hollow slats extending between the first and second side support frames and being arranged to cooperatively define a surface having a substantial area to directly contact and support a person in a seated position; and a supplemental seating section slidably connected to the primary seating section, the supplemental seating section comprising:

a third side support frame positioned on the side of the second side support frame opposite that of the first side support frame; and a second plurality of slats equal in number to that of the first plurality of slats, each slat in the second plurality of slats having one end rigidly connected to the third side support frame and the other end slidable engaging within a different one of the slats in the first plurality of slats to permit the third side support frame and the second plurality of slats to slidably move between a retracted position in which the third side support frame is positioned proximally to the second side support frame and in which slats in the second plurality of slats are slid into the slats in the first plurality of slats, and an extended position in which the third side support frame is distally spaced from the second side support frame and in which the slats in the second plurality of slats are extended from the first set of slats to cooperatively define a surface having a substantial area that is directly exposed to support a person in a seated position so as to provide additional seating space.

19. A laterally extendable chair as set forth in claim 18, wherein the slats in the first and second plurality of slats are arranged to so that each seating section includes a respective bottom support and a respective back support extending upwardly from the back edge of the bottom support.

20. A laterally extendable chair as set forth in claim 18, wherein the supports are formed from a molded material.

21. A laterally extendable chair as set forth in claim 18, wherein a portion of a printed message is disposed on at least one of the first plurality of slats and the remainder of the printed message is disposed on at least one of the second plurality of slats such that the complete message is visible only with the chair in the extended position.

22. A laterally extendable chair as set forth in claim 18 wherein each slat in the first plurality of slats has a flat upper surface portion to directly control and support a person in a seated position.

23. A laterally extendable chair as set forth in claim 18 wherein there are at least three slats in the first plurality of slats.

24. A laterally extendable chair as set forth in claim 18 wherein the primary seating section has a front and a rear and the slats in the first plurality of slats are spaced substantially regularly between the front and rear of the primary seating section.

* * * * *